United States Patent [19]

Gnesa

[11] Patent Number: 4,793,731

[45] Date of Patent: Dec. 27, 1988

[54] ROAD COATING SYSTEM

[76] Inventor: Edward C. Gnesa, 160 Patterson Rd., Santa Maria, Calif. 93455

[21] Appl. No.: 80,783

[22] Filed: Aug. 3, 1987

Related U.S. Application Data

[63] Continuation-in-part of Ser. No. 874,033, Jun. 13, 1986, Pat. No. 4,684,289.

[51] Int. Cl.[4] ..... E01C 23/03

[52] U.S. Cl. ..... 404/83; 404/93; 404/94; 404/100; 404/111; 156/575

[58] Field of Search ..... 404/83, 93, 94, 101, 404/108, 110, 111, 100; 118/108; 156/575, 577

[56] References Cited

U.S. PATENT DOCUMENTS

| | | | |
|---|---|---|---|
| 2,503,560 | 4/1950 | Moyer | 156/575 X |
| 3,625,804 | 12/1971 | Losey et al. | 156/575 |
| 4,456,399 | 6/1984 | Conover | 404/83 X |
| 4,684,289 | 8/1987 | Gnesa | 404/94 X |
| 4,699,330 | 10/1987 | Barazone | 404/94 X |

*Primary Examiner*—Jerome W. Massie
*Assistant Examiner*—Matthew Smith
*Attorney, Agent, or Firm*—Kenneth J. Hovet

[57] ABSTRACT

A truck having a road oil spreader is equipped with an apparatus for simultaneous application of oil and paving fabric to the road surface. The apparatus includes an assembly for engaging a roll of paving fabric comprising adjustable cone arms mounted on end plates that rotatably hold the core of the fabric roll. The fabric is drawn over a guide shaft and beneath a sectioned box beam having a series of longitudinally aligned brushes. The shaft and brushes are connected to the opposing end plates which are attached to a lateral support beam. The end plates and box beam include joint, drive and connection means that permit longitudinal, vertical and angular adjustment of the guide shaft and brushes. As oil is sprayed over the road surface, the fabric unrolls and becomes embedded in the oil by action of the brushes pushing the fabric into the oil-coated surface.

27 Claims, 6 Drawing Sheets

ROAD COATING SYSTEM

This application is a continuation-in-part of U.S. application Ser. No. 874,033 filed June 13, 1986, now U.S. Pat. No. 4,684,289 dated Aug. 4, 1987.

BACKGROUND OF THE INVENTION

1. Field of the Invention

The present invention relates to the coating of road surfaces and, more particularly, to a system for applying fabric and fluid road coating material to a pavement.

2. Brief Description of the Prior Art

Until discovery of the present invention, application of fabric to an oil coated pavement was accomplished in two separate steps. A tank truck with an oil spreading apparatus was used to apply hot oil to a road surface. A separate vehicle with a loader assembly carrying a roll of paving fabric followed behind the tank truck. An example of such vehicle is shown in U.S. Pat. No. 4,555,073. The vehicle driver would guide the assembly to unroll the fabric onto the oil in the desired alignment with the street and/or edge of previously applied fabric. A series of brushes were used to push the fabric into the oil.

The above sequence required two vehicle operators plus associated helpers for each operation. Capital expense, maintenance costs and labor were very high. Oftentimes, before the fabric could be pressed into the hot oil, the oil would become too cool and viscous to permit proper adherence. In such cases, recoating of the street or the use of additional equipment to soften the oil was needed.

SUMMARY OF THE INVENTION

The present invention provides an improved system for the simultaneous application of fluid pavement coating material and fabric to a roadway, pathway, driveway or the like. It comprises a fabric application means operating in conjunction with a fluid application means.

In general, a lateral mounting means serves to interconnect a fabric roll engagement means and a fabric press means. The lateral mounting means is attached to a support beam which is secured to the frame of a vehicle containing a supply of the coating material. As the vehicle moves in a predetermined path on a pavement, the material is applied while a sheet of fabric is drawn from the roll and pressed into the fluid material. The sheet is directed onto the material by a fabric guide means that includes an elongatable sectioned structure having yieldable fabric contact means.

The lateral mounting means comprises an end plate connected to each opposing end of the support beam. A joint means forms a sliding connection so the plate may be raised or lowered. This, in turn, raises and lowers the fabric roll engagement means and fabric press means thereby effecting an efficiency in structure and operation.

The support beam includes lateral adjustment means for transversely displacing the end plates which, also, produces an elongation or contraction of the fabric press means. In a like manner, it further expands or contracts the spacing between opposing fabric roll insert means for engagement with fabric rolls of varying lengths. Since the fabric contact means preferably presses against the entire width of a sheet of paving fabric, it can be seen that the above arrangement will automatically adjust the contact means length to the fabric width and insure a continuum of engagement.

DESCRIPTION OF THE PREFERRED EMBODIMENTS

Figure 1:
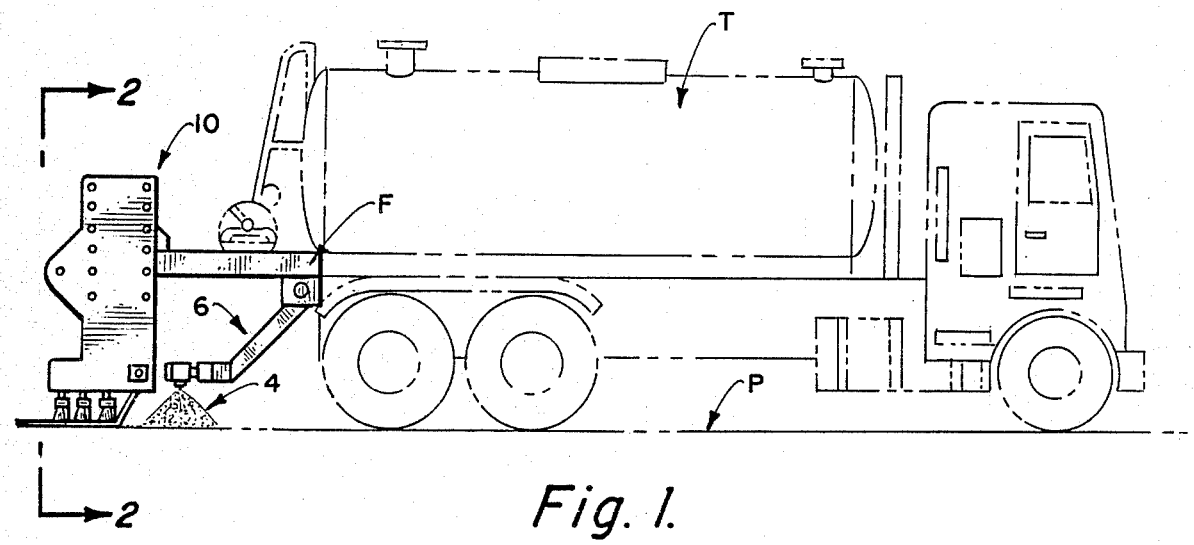
FIG. 1 is a side elevational view of a tank truck in phantom to which is attached the road coating system of the present invention.
Figure 4:
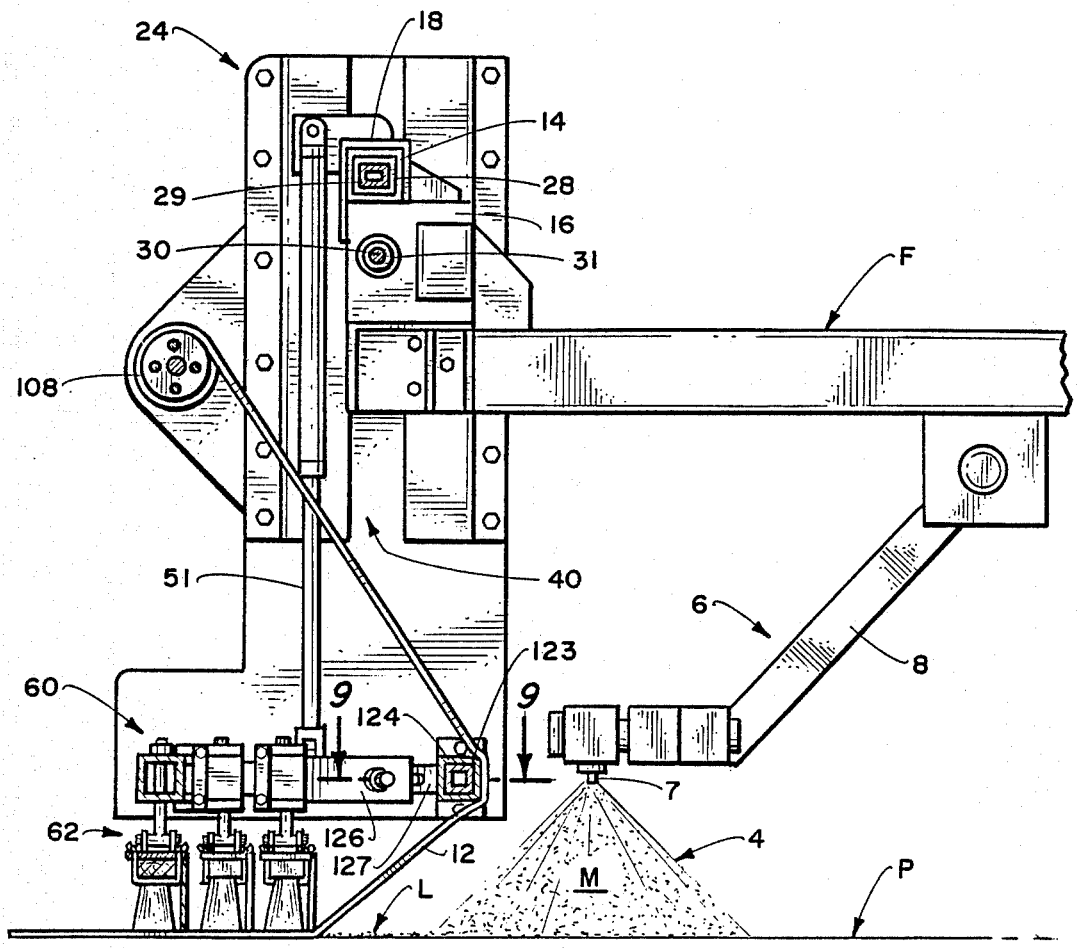
FIG. 4 is a side elevational view taken along lines 4—4 of FIG. 2.

With initial reference to FIG. 1 of the drawings, a truck is shown having a frame (F) and a tank (T). The tank is used for storage of liquid road coating material (M). The material typically comprises an oil or resinous composition which, usually when heated, can be sprayed as shown by reference 4 onto a pavement (P).

A fluid application means 6 is used to apply the material which, as shown, is done by a series of spray nozzles 7 attached to a movable oil beam 8. Simultaneous with the application of a layer (L) of material to a pavement, a sheet application means 10 is used to apply a continuous sheet of paving fabric 12 onto the layer.

Attached to the truck frame (F) is support beam 14. As shown, the support beam is mounted upon truck frame part 16 which includes a center securement clamp 18. The beam includes opposing ends 20 which are connected to corresponding lateral mounting means shown as end plates 24.

Included with the beam is a lateral adjustment means that permits sideways movement of the end plates transverse to the longitudinal axis of the truck. To effect such movement, the beam comprises a telescoping structure having a stationary midportion 27 into which successively extend opposing intermediate portions 28 and opposing outer portions 29. The beam is box-like in cross-section with the midportion having the largest cross-sectional area followed by the intermediate and then the outer portion areas. The outer portions include a terminal end 21. Interior catch mechanisms (not shown) are used to limit the axial distance each portion can extend beyond the other.

It will be appreciated that other longitudinally expandable support means could be used in place of the telescoping assembly described above. For example, offset sliding bar means, rack and pinion means, cable systems and tubular structures could accomplish the same purposes.

Lateral drive means are used to longitudinally expand or contract the opposing movable portions of the support beam. As shown, such means comprise two oppositely directed drive shafts 30. The shafts may be powered electrically, mechanically or by hydraulic or pneumatic cylinders. The elongated cylinders 31 shown in the drawings are hydraulically operated in a manner known in the art.

The cylinders 31 are connected to stationary frame parts 16. Each cylinder includes the aforementioned drive shaft 30 which extend and reciprocate in opposite directions parallel to the beam 14. The end of each shaft is connected to a junction means on each respective end plate.

Figure 6:
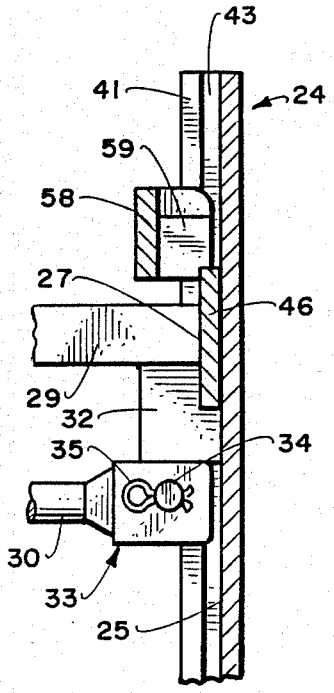
FIG. 6 is an enlarged cross-sectional view taken along lines 6—6 of FIG. 5.

With reference to FIG. 6, the junction means includes a connector plate 32 secured to ends 20 of the support beam. A bifurcated shaft connector 33 extends about the plate with a cross bar 34 extending through corresponding openings of the shaft connector and connector plate. A lock pin 35 secures the cross bar from disengagement. A similar junction means arrangement is used to secure the cylinders to frame part 16 at fixed end 36.

Figure 2:
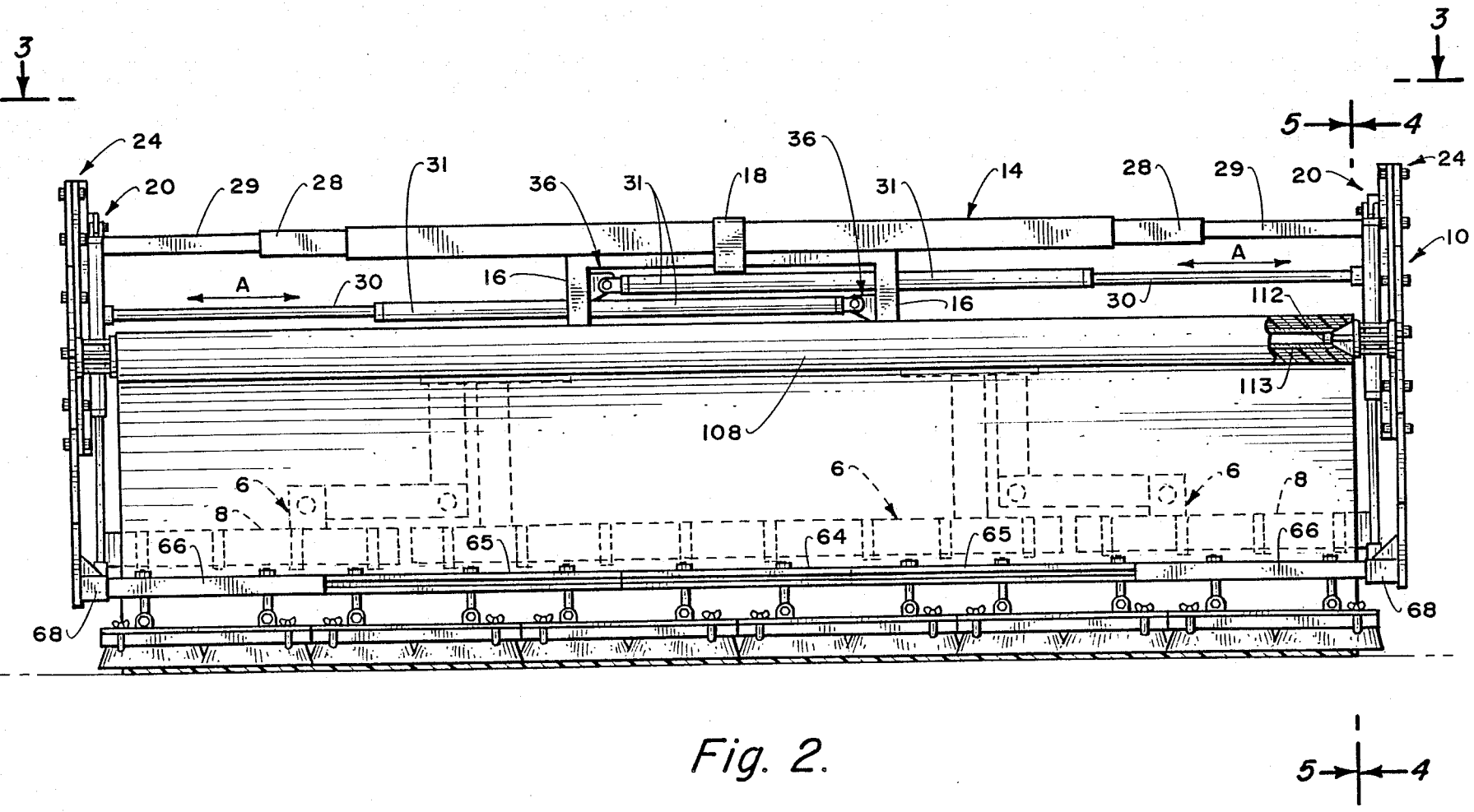
FIG. 2 is an enlarged end view of the system taken along lines 2—2 of FIG. 1 with the fluid application means shown in phantom.

Upon actuation of a hydraulic system on the truck (not shown), the cylinders will drive the shafts outwardly or inwardly as shown by arrows A in FIG. 2. This will correspondingly position the end plates in whatever position is desired. Although not required, it is preferred that each shaft move in unison in an equal and opposite direction to maintain the end plates (and overall system) concentric and centered relative to the truck centerline c,c.

Each end 20 of the support beam is connected to a respective end plate by a joint means. The joint means includes an end plate constraint means shown as elongated slot 40. The slot is defined by the area between edges 41 of spaced-apart constraint plates 42 which are secured by plate fasteners 44 to the upper portion of the end plates. The slot is aligned about vertically on the inside face of each plate and includes an undercut region 43 for sliding engagement with a retention means shown as beam plate 46. Undercut region 43 is the area between the end plate inner face and the offset portions 45 of the constraint plates.

Beam plate 46 is secured across the terminal end 21 of each opposing outer portion of the support beam. It is a flat plate aligned perpendicular to the support beam longitudinal axis and has sufficient width to span slot 40 and be retained behind offset portions 45 of the constraint plates. As so restricted, its only movement will be in the direction of the slot.

Figure 5:
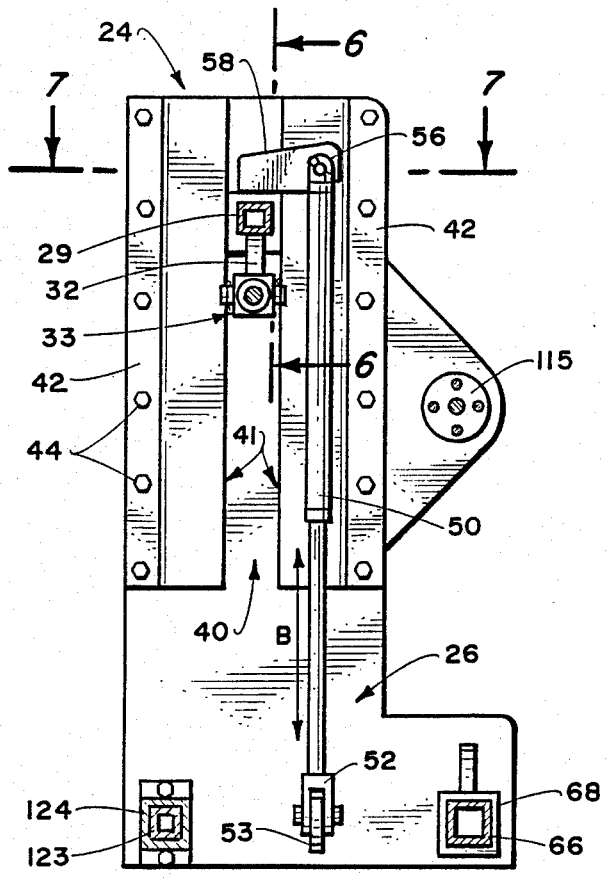
FIG. 5 is a side elevational view taken along lines 5—5 of FIG. 2.

A plate drive means is used to effect raising and lowering of the end plates as directed by the aforementioned slot. Such means may be any of those discussed with respect to the lateral drive means. As shown in FIG. 5, it comprises a hydraulic cylinder 50 having a reciprocable shaft 51. The shaft includes forked end 52 which is cross-pinned to a fixed stub plate 53 extending from the lower portion of end plate face 25.

The upper end of cylinder 50 is likewise secured by a forked end 56 which is cross-pinned to curved plate 58. The curved plate is secured to beam plate 46. It is provided with gusset plate 59 which also is secured to the beam plate. In this manner a strong reinforced connection is made so that the end plate will be entirely supported by beam 14 with the end plates being suspended from each of the respective curved plates by the above-described plate cylinder/shaft and associated connections. With reference to arrows B in FIG. 5, when the cylinder is actuated, shaft 51 can be retracted and draw the end plate lower portion 26 upwardly toward the support beam. And, vice versa, the shaft can be extended for lowering the end plate relative to the support beam.

A fabric press means 60 is connected to each of the opposing end plates. It spans the distance between each of the plates and, therefore, is elongatable for adjusting to changes in end plate spacing. Yieldable fabric contact means 62 is included for pressing the paving fabric onto the layer of pavement coating material.

Figure 3:
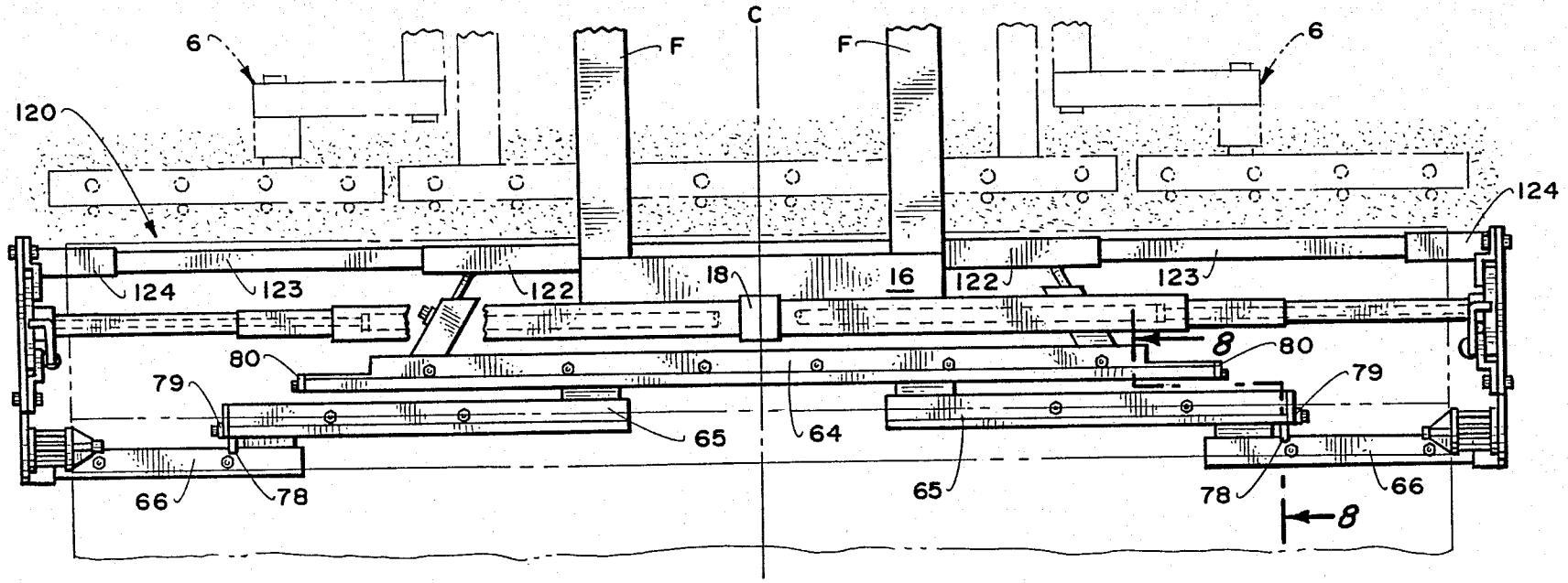
FIG. 3 is a top plan view taken along lines 3—3 of FIG. 2.

With particular reference to FIG. 3, a sectioned structure is shown comprising a center section 64 from which extend opposing midlateral sections 65 and outermost lateral sections 66. The outer end of the outermost sections are secured to a connector sleeve 68 which is fixed to the lower rearward portion of the end plate.

Figure 8:
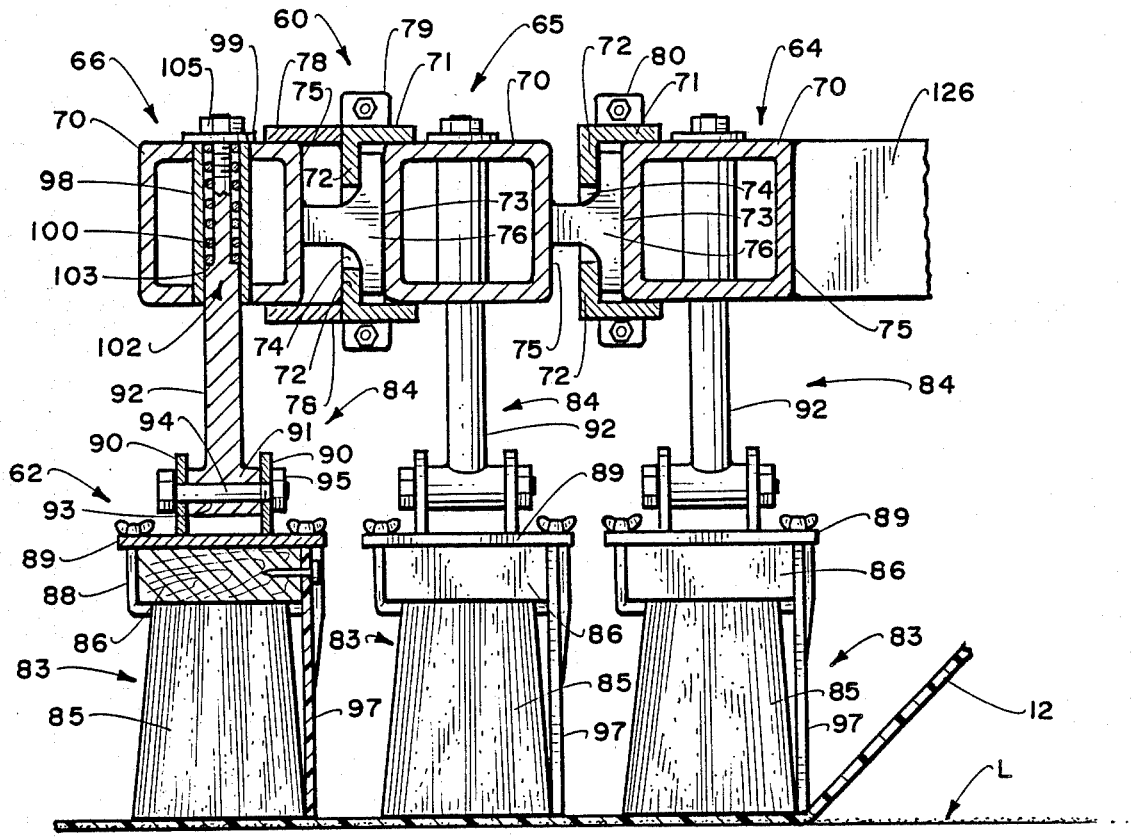
FIG. 8 is an enlarged cross-sectional view taken along lines 8—8 of FIG. 3.

Each section comprises a box beam 70 with slide connector means for connecting the sections to each other. As shown in FIG. 8, the rearward upper end lower edges of the center and midlateral section box beams are provided with angle bars 71. The rearward legs 72 are spaced from each other and from rearward face 73 of the box beam to define an overhung lateral slot 74.

Extending from about the median line of the forward face 75 of the midlateral and outermost section box beams are slot engagement members shown as T-bars 76. The T-bars project into the slot 74 and are retained therein by the angle bar rearward legs 72. The angle bars extend along the length of the aforementioned sections to permit complete lateral movement of the sections relative to each other.

The T-bars have a length less than half the length of the sections to allow for adequate, but sufficiently supported, extension of each movable section beyond the other. In this regard, not that the upper and lower edges of the outer end of the midlateral sections are provided with rearwardly extending tabs 78. These provide support for the midlateral sections when fully extended as shown in FIG. 3.

Abutment means shown as midlateral section end beam plates 79 are used to set the limits for lateral extension of the outermost sections. When being expanded from the fully retracted position shown in FIG. 10, the outermost sections will move first as the end plates are moved outwardly (as shown by arrows C). When the outer end of T-bar 76, which extends from the outermost sections, engages midlateral beam plate 79 of the midlateral sections, the midlateral sections will then be drawn outwardly along slot 74 of the center section. The center section will remain stationary with its midpoint coextensive with the aforementioned truck centerline. Each end of the center section is provided with a center beam plate 80 that prevents overextension of the midlateral sections.

Attached to the box beam of each section is the yieldable fabric contact means 62. This includes a fabric press means comprising embedding means 83 attached to the box beams by connector means 84. The embedding means comprises spaced-apart brush units 85 having a base 86 from which extend bristles 87. The bristles are relatively stiff and flare downwardly and outwardly from the base. The brush units on each section are preferably juxtapositioned so that bristles at opposing sides will contact the side bristles of an adjacent brush. In this manner, a staggered continuum of bristles below each of the sections will effectively operate against fabric 12 and cause its even bubble-free embedment into the pavement material.

For purposes of the present invention, it will be understood that embedding means may also comprise one or a series of roller units in place of, or in combination with, the aforementioned brush units. Further, the embedding means may include a deflectable panel 96 adjacent the forward side of the bristles. This will help to increase bristle life and enhance wrinkle-free fabric embedment.

The connector means 84 preferably includes a biasing mechanism that will facilitate yieldable contact of the bristles with the fabric over contoured or irregular pavement surfaces. As best shown in FIG. 8, the connector means includes a pair of U-bolts 88 which secure brush base 86 to a base plate 89. The base plate has two pairs of spaced-apart connector elements 90 extending from opposing sides of the plate upper surface. The cross-portion 91 of a T-shaft 92 fits across the pair of connector elements. The cross-portion has an opening 93 through the longitudinal extent thereof and bolt 94 passes through the opening and corresponding openings in each element 90 to form a connection. Nut 95 is used to secure the bolt.

The box beams 70 are provided with a series of spaced-apart center openings through the upper and lower wall thicknesses. Corresponding upper and lower openings are joined with a pipe section 98 traversing the beam interior. A washer 99 with an opening of slightly less diameter than the upper opening is secured concentrically about the upper opening to provide an inner abutment for spring 100. T-shaft 92 includes a stem portion having an upper section 102 of reduced diameter with an annular shoulder 103.

The top end of the stem portion is threaded for engagement with stop nut 105. Spring 100 encircles the upper section 102 and is held in a compressed state between washer 99 and shoulder 103 by securement of the stop nut. As so arranged, the stem portion will reciprocate within pipe section 98 in reaction to vertical movement of brush unit 85. Such movement will be against the bias of spring 100, the strength of which can be adjusted by tightening or loosening nut 105. Rotation of the stop nut also allows for minor adjustment in the vertical placement of the brush units. This is desirable because it provides a way to compensate for bristle wear.

A fabric roll engagement means is connected to each end plate 24 for holding a roll of paving fabric 108 and guiding a continuous sheet 12 of the fabric from the roll onto a layer (L) of pavement coating material. Such engagement means comprises a roll insert means 110 and a fabric guide means 120.

Figure 7:
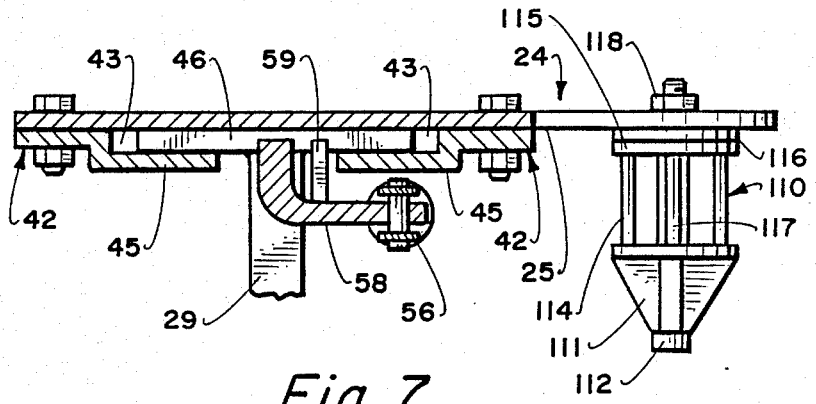
FIG. 7 is a cross-sectional view taken along lines 7—7 of FIG. 5.

As shown in FIGS. 2 and 7, the roll insert means comprises a cone member 111 having an apex 112 directed inwardly from a coextensive point on a respective end plate. The apex of each member is adapted to enter the opposite end of the tubular core 113 of roll 108. The cone member includes spacer bars 114 connected to a bearing plate 115 which rotates against a bearing ring 116. The bearing ring is secured to face 25 of the end plate and facilitates rotation of the cone member about axle 117.

The end of the cone axle is threaded and the entire member is secured to about the end plate midportion, rearwardly offset from constraint plates 42, by axle nut 118. With the above arrangement, movement of the end plates will produce a like movement of the cone members which thereby coact in opposing directions to engage or disengage the fabric roll core 113.

On occasion, the roll core 113 may be damaged or become wet and too weak to fully support the weight of a full roll of fabric. Also, it may become necessary to utilize fabric rolls of shortened length for narrow roads, drives or paths. In such cases, the roll insert means may include the use of an elongated extension having a cone member on its end (not shown). The extension may be attached to the existing cone member and thereby rotate as above-described. The extension may be used to engage both ends of roll 108 not only for damaged cores, but to center or otherwise shift rolls or shortened length with respect to the truck centerline.

The fabric guide means 120 operates to direct the continuous sheet 12 of fabric from roll 108 to beneath the embedding means 83. it comprises a sleeve coupling 122 with guide shafts 123 laterally extendable in opposing directions. The outer end of each shaft is secured to an end plate by a connector tube 124. Each connector tube is secured to a coextensive lower forward portion of each respective end plate.

As best shown in FIG. 3, the guide shafts telescope within the sleeve coupling and are drawn outwardly with a like movement of the end plates. The sleeve coupling remains centered, relative to the truck centerline, during movement of the guide shafts. It includes bracket means which connect it to center section 64 of the fabric press means.

Figure 9:
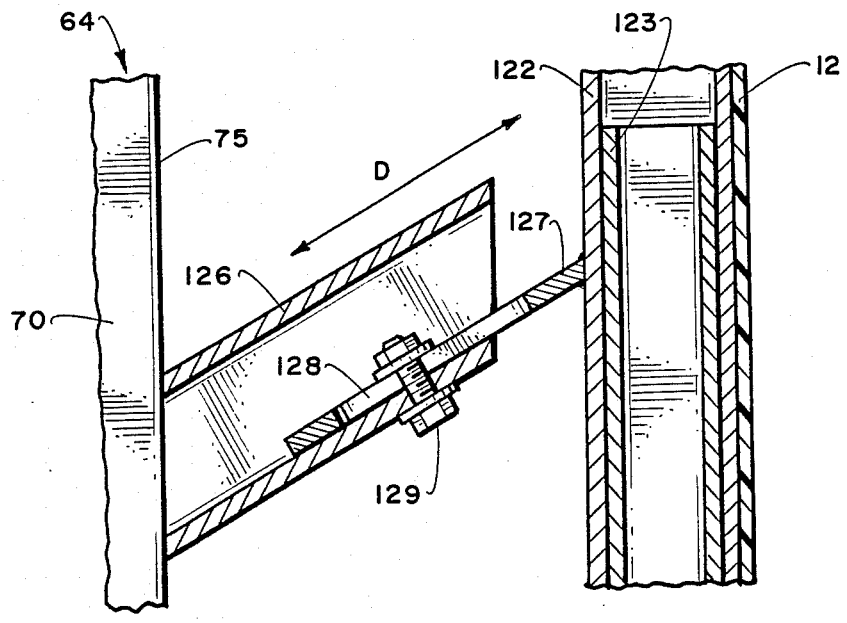
FIG. 9 is an enlarged cross-sectional view taken along lines 9—9 of FIG. 4.

The bracket means comprise a pair of section arms 126 that engage a corresponding pair of coupling arms 127. The section arms extend from outer portions of the center section forward face 75. They include a fastener 129. A coupling arm extends rearwardly from outer portions of the sleeve coupling into sliding engagement with a corresponding section arm. Each coupling arm includes a slot 128 through which fastener 129 extends for securing the arms together at the desired spacing. As shown in FIG. 9, the overall assembly not only provides support for the coupling sleeve, it provides an adjustment means for regulating the alignment and spacing, shown by arrows D, of the fabric guide means relative to the fabric press means.

Operation

Upon arrival at the job site, it is expected that the road surface will have been cleaned and all large cracks and holes filled. The truck tank will contain the pavement coating material such as hot asphaltic paving oil. The truck oil circulating pump, heating means, hydraulic pump and overall control systems will be in operation.

Figure 10:
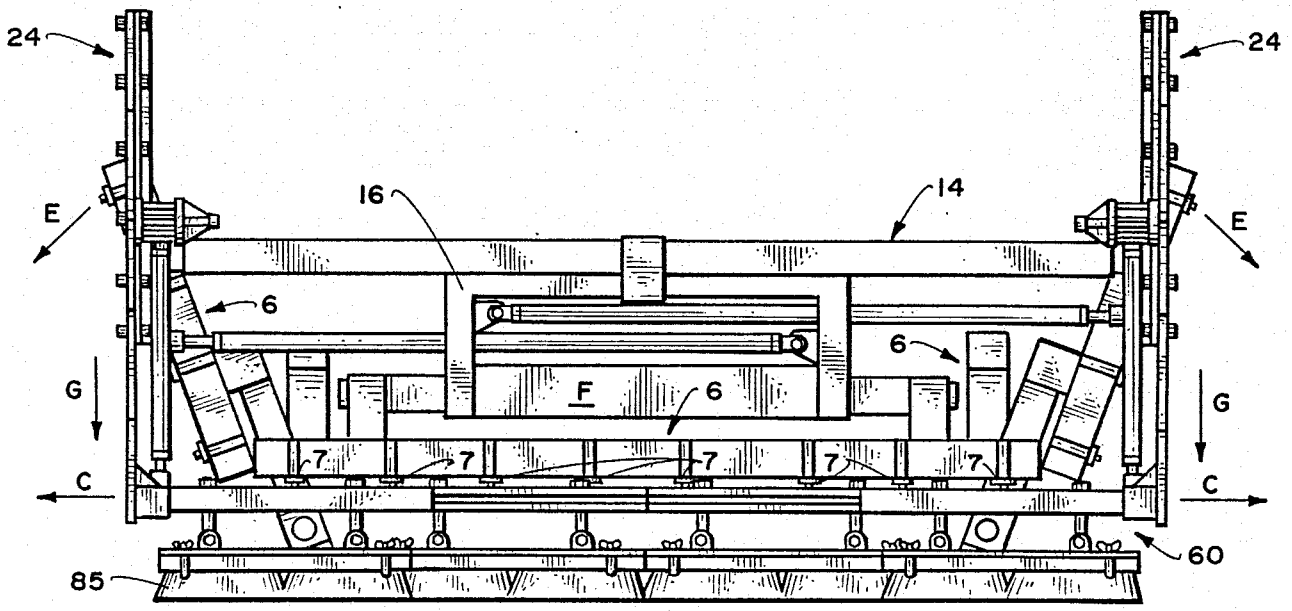
FIG. 10 is an end view similar to FIG. 2 with the road coating system in a non-operative elevated and contracted position.

As shown in FIG. 10, the fabric and fluid application means will be in a fully retracted and elevated position as a result of travelling to the job site. The fluid application means will be made operative by swinging the hinged oil spreader beams downwardly as shown by arrows E. Hot oil can then commence circulating through the beams.

The end plates 24 may next be moved outwardly, as shown by arrows C, by actuation of the lateral drive means. If deemed necessary, a removable stay pin or retainer means may connect the truck frame and center section 64. This will prevent unwanted lateral shifting. A roll of paving fabric is then positioned between the roll insert means and the end plates are moved inwardly until the roll core 113 is engaged by the cone members 110. If needed, the cone member extensions can be utilized.

After the fabric roll is engaged, the leading end of the fabric sheet will be drawn forwardly from the roll and down over the fabric guide means 120. From there, it will be directed rearwardly beneath the brush units until it can be adhered to an oiled surface at a predetermined starting line or adjacent the trailing end of a previously laid fabric. It is expected that oil will exist beneath the brush units up to the nozzle spray zone from a previous application or by initial manual application to permit adherence of the fabric during the initial movement forward of the tank truck.

With the sheet in place on the pavement, the end plates are lowered, as shown by arrows F, until the brush units firmly contact the sheet. Hot oil spray will be started simultaneous with forward movement of the truck. Fabric will be drawn continuously from the roll in direct relation to the distance travelled by the truck as a result of the fabric's adherence to the oil on the road.

As the fabric unrolls, the brush units will push it into the oil and cause it to become soaked therewith. Coordination of truck speed, oil temperature, viscosity, spray nozzle spacing and oil application rate, as well as the fabric thickness, texture and strength is accomplished in a manner known in the art and is not part of this invention.

The truck will be guided in a controlled manner so that the fabric will be applied to the road surface directly adjacent the side edge of a previously applied fabric and/or in a line as determined by the road direction. As one roll of fabric is exhausted, the above process can be repeated with successive rolls.

Upon completion of a job, the fabric roll will be removed and all parts exposed to oil will be cleaned with solvent. The end plates will be lifted and retracted in reverse of the above-described steps and the oil beam will be folded and secured for travel to the next job site.

From the above it will be apparent that the invention provides a great improvement in the movement and positioning of all structures used in simultaneously coating a pavement with oil and fabric. Preferably, the structures will be symmetrical about the truck centerline with each end plate being approximately a mirror image of the other. These features simplify both the use and the manufacture of the equipment.

Also note that controlling the end plate position will result in automatic control of both the fabric press means and the fabric guide means position. Further, the above means will be automatically referenced to the predetermined fabric width since the end plates provide the engagement means for the rolls of fabric. As such, the invention allows a significant economy in equipment operation time and labor costs. Also, structural repair and maintenance costs will be greatly reduced.

While the invention has been described with respect to preferred embodiments, it will be apparent to those skilled in the art that various modifications and improvements may be made without departing from the scope and spirit of the invention. Accordingly, it is to be understood that the invention is not to be limited by the specific embodiments, but only by the scope of the appended claims.

I claim:

1. A system for coating a roadway from a moving vehicle comprising:

fluid application means attached to said vehicle for applying a fluid road coating material to the surface of said roadway;

fabric application means attached to said vehicle for applying a sheet of paving fabric onto said material simultaneous with the application of said material to the roadway;

said fabric application means comprising a support beam attached to said vehicle having opposing ends attached to a lateral mounting means by a joint means, said lateral mounting means including fabric roll engagement means for engaging a roll of paving fabric and allowing the rotation of said roll so that a continuous sheet of said fabric may be drawn from said roll, and fabric press means for pressing said fabric into said material including plate drive means for raising and lowering said fabric press means relative to the roadway.

2. The system of claim 1 including lateral drive means for moving said lateral mounting means transversely of the vehicle.

3. The system of claim 1 wherein said joint means includes retention means at said beam opposing ends in engagement with constraint means on said lateral mounting means.

4. The system of claim 2 wherein said fabric press means comprises a beam structure having yieldable fabric contact means for pressing said fabric into said material.

5. The system of claim 6 wherein said fabric roll engagement means includes a guide means extending about parallel with said beam structure for guiding said fabric from said roll to said fabric contact means.

6. In a pavement coating apparatus with a truck having a truck frame and a means for applying pavement coating material onto a pavement while simultaneously applying a sheet of paving fabric onto said material with a fabric application means, said fabric application means comprising:

a support beam connected to said truck frame;

an end plate attached to each opposing end of said support beam including a plate drive means for raising and lowering said end plate;

an expandable fabric press means connected to said end plates; and, fabric roll engagement means connected to each end plate for holding a roll of paving fabric and guiding a continuous sheet of said fabric from said roll onto said pavement coating material.

7. The apparatus of claim 6 including a joint means for attaching said end plate to each of said support beam ends.

8. The apparatus of claim 7 wherein said joint means comprises a retention means at said each end in engagement with an end plate constraint means.

9. The apparatus of claim 8 wherein said constraint means comprises an elongated slot and said retention means is in sliding engagement with said slot.

10. The apparatus of claim 7 wherein said plate drive means interconnects said support beam and said end plate whereby actuation of said plate drive means will raise and lower said end plate.

11. The apparatus of claim 10 wherein said joint means comprises a retention means at each of said support beam ends in sliding engagement with a slot on each respective end plate.

12. The apparatus of claim 6, wherein said fabric press means includes a center section from which extend movable lateral sections.

13. The apparatus of claim 6, wherein said support beam includes lateral adjustment means for the transverse displacement of said end plate.

14. The apparatus of claim 12 wherein said lateral sections include opposing outermost lateral sections each of which are attached to a respective end plate.

15. The apparatus of claim 14 wherein said center and lateral sections are provided with slide connector means for connecting the sections to each other.

16. The apparatus of claim 15 including elongatable lateral drive means interconnecting said truck frame and each of said end plates to cause lateral movement of each plate.

17. The apparatus of claim 15 wherein said slide connector means comprises a lateral slot extending along the side of said sections with a slot engagement member extending outwardly from the side of an adjacent section into said lateral slot.

18. The apparatus of claim 16 wherein said slide connector means includes abutment means for predetermining the extent of outward axial movement of each of said lateral sections.

19. The apparatus of claim 16 wherein said center and lateral sections include fabric press means for pressing said paving fabric onto said material.

20. The apparatus of claim 19 wherein said fabric press means comprise brush units aligned longitudinally along said center and lateral sections, said units extending downwardly from said sections with brush connector means.

21. The apparatus of claim 20 wherein said brush connector means includes a connector shaft having an upper portion mounted for axial movement within said sections and a lower portion connected to said brush units.

22. The apparatus of claim 21 wherein said brush units include bristles and a deflectable panel both for engaging and pressing said fabric against said material.

23. The apparatus of claim 8 wherein said fabric roll engagement means comprises a roll insert means extending inwardly from coextensive portions of each end plate.

24. The apparatus of claim 23 wherein said fabric roll engagement means includes fabric guide means connected to said end plates for directing said sheet of fabric toward said fabric press means.

25. The apparatus of claim 24 wherein said fabric guide means comprises a sleeve coupling with guide shafts laterally extendable in opposing directions each having an outer end connected to a respective end plate.

26. The apparatus of claim 25 wherein said fabric press means includes a center section and said sleeve coupling is connected to said center section with bracket means.

27. The apparatus of claim 26 wherein said bracket means includes adjustment means for regulating the alignment and spacing of said fabric guide means relative to said fabric press assembly.

* * * * *